United States Patent [19]

Kollar et al.

[11] 4,396,274

[45] Aug. 2, 1983

[54] ELECTROPHOTOGRAPHIC COPIER CONFIGURATION

[75] Inventors: Ernest P. Kollar, Longmont; Richard E. Norwood, Boulder, both of Colo.

[73] Assignee: International Business Machines Corporation, Armonk, N.Y.

[21] Appl. No.: 344,142

[22] Filed: Jan. 29, 1982

Related U.S. Application Data

[63] Continuation of Ser. No. 99,800, Dec. 3, 1979, abandoned.

[51] Int. Cl.[3] ..... G03G 15/04; G03G 15/22

[52] U.S. Cl. ..... 355/3 BE; 198/811; 198/813; 198/16

[58] Field of Search ..... 355/3 R, 3 BE, 16; 271/183; 198/811, 813

[56] References Cited

U.S. PATENT DOCUMENTS

| | | | |
|---|---|---|---|
| 3,661,452 | 5/1972 | Hewes et al. | 355/3 R |
| 3,720,465 | 3/1973 | Bruce et al. | 355/8 |
| 3,807,854 | 4/1974 | Tanaka et al. | 355/16 |
| 3,841,751 | 10/1974 | Draugelis et al. | 355/4 |
| 3,877,806 | 4/1975 | Schrempp et al. | 355/16 |
| 4,002,047 | 1/1977 | MacPhee et al. | 271/183 X |
| 4,003,651 | 1/1977 | Hashida et al. | 355/16 |
| 4,013,284 | 3/1977 | Demetre | 271/183 |
| 4,013,359 | 3/1977 | DuBois et al. | 355/16 |
| 4,060,236 | 11/1977 | Carstedt | 271/183 |
| 4,063,809 | 12/1977 | Schrempp et al. | 355/16 X |
| 4,089,516 | 5/1978 | Colglazier et al. | 271/9 |
| 4,119,309 | 10/1978 | Mayer et al. | 271/183 |
| 4,181,426 | 1/1980 | Blossey et al. | 355/16 |
| 4,188,110 | 2/1980 | Stange | 355/3 BE |

*Primary Examiner*—Fred L. Braun

*Attorney, Agent, or Firm*—Francis A. Sirr; Joscelyn G. Cockburn

[57] ABSTRACT

An electrophotographic copier with an endless photoconductor belt adapted to move around a cylindrical drum and a flat platen. A vacuum column is positioned between the cylindrical drum and the platen. The vacuum column creates a concave bend in the photoconductor, enabling a latent image of a document to be placed on a flat run of the photoconductor belt, and enabling charging, developing, transferring and cleaning of the photoconductor belt to occur about a curved run of the photoconductor belt.

9 Claims, 5 Drawing Figures

ELECTROPHOTOGRAPHIC COPIER CONFIGURATION

This is a continuation of application Ser. No. 099,800 filed Dec. 3, 1979, now abandoned.

BACKGROUND OF THE INVENTION

1. Field of the Invention

The invention relates to electrophotographic copying machines. More particularly, the invention relates to a unique configuration for a belt type electrophotographic machine.

2. Prior Art

The electrophotographic copying process which is used primarily for reproducing copies of original documents is well known in the prior art. Although there are several variations to the process, the basic process requires a photoreceptor or photosensitive element. The photosensitive element is charged by a corona. The photosensitive element usually operates as an insulator in the dark and as a conductor in the light. After charging, the photosensitive element is next exposed to an imaging station. At the imaging station the photosensitive element is selectively discharged in accordance with the informational contents of an original document. The selectively discharge section of the photosensitive element contains a latent image of the original document. The latent image is developed by a developing material such as toner powder. The toned image is next transferred to a supporting media such as paper. The image is then fused into the paper to form a permanent copy of the original. The photosensitive element is cleaned and the above-enumerated process is repeated.

In order to selectively discharge the photosensitive element, the prior art uses either a flash illumination or a narrow footprint of light for scanning the original document. The flash illumination seems to be more efficient in that a complete footprint of the document is incident on the photosensitive element in a relatively short time interval. The short time interval is hereinafter called the scan cycle. As such, the throughput (that is, number of copies reproduced) of the electrophotographic copier can be significantly increased without changing the process speed of the other electrophotographic processing steps. On the other hand, when the footprint of light is used to scan the original document, only sections of the document are incident, sequentially, onto the photosensitive element. Also, the scan cycle includes a flyback time wherein no useful scanning is done. However, the flyback time is necessary so that the mechanism which generates the narrow footprint of light can be repositioned at its home position prior to the beginning of another scan cycle. The net result is that the time required to scan an original document is increased and the throughput on such an electrophotographic copier is reduced.

Prior art electrophotographic copiers which reproduce copies by using the above-enumerated process may be divided into two classes; the so-called belt type electrophotographic copiers and the drum type electrophotographic copier. Each type of the prior art electrophotographic copier will be discussed hereinafter with particular emphasis on the shortcomings associated with each type.

U.S. Pat. No. 4,089,516 is an example of the drum type prior art electrophotographic copier. The copier includes a cylindrical drum with a length of photosensitive material wrapped about its surface. The drum is journaled for rotation about a shaft which is mounted to the frame of the copier. A plurality of processing stations (including charging, imaging, developing, transferring and cleaning) are positioned around the periphery of the cylindrical drum. In order to copy an original document, the document is placed on the document platen. A narrow footprint of light is generated by the illumination system. The footprint of light scans the document and the light rays reflecting from the document are focused through the optical path of the system to form a latent image onto the photosensitive material. The latent image is developed and transferred to a support media. The image on the support media is fused by a heat source to form a permanent copy.

This type of prior art electrophotographic copier has several meritorious characteristics. For example, compactness of the machine. Generally less space is required to package the copier since the processing stations are arranged in a circular configuration. Also, cleaning and stripping the transfer media from the photosensitive element is done more efficiently since the photosensitive element has a continuous curvature. Perhaps the nonmeritorious characteristic of the system is that flash illumination cannot be used to discharge the photosensitive material. The reason is that the photosensitive material is curved and only a portion of the photosensitive material can be discharged at any instant of time. As a result, the throughput of this type of electrophotographic copier is usually relatively low.

U.S. Pat. No. 3,661,452 exemplifies a belt type prior art electrophotographic copier. In this type of copier, an endless photosensitive belt is supported for travel, in an endless generally triangular path, by a plurality of rollers. At least one of the rollers is biased, by mechanical means such as a spring, to create tension in the belt. a plurality of conventional processing stations are positioned in proximity within the orbit of the photosensitive belt. The processing station includes a flash illumination system for exposing the photosensitive belt on a first flat run. The exposed photosensitive belt is developed by a development station which is positioned relative to a second flat run of the belt. At least one of the rollers has a sufficiently wide diameter to curve the belt at a point between the flash illumination system and the development station. Image transfer from the belt to a supporting media, such as paper, occurs at the curved section of the belt.

Although the above-described belt type electrophotographic copier is an improvement to the prior art in that it incorporates one feature (namely, image transfer at a curved surface) from the prior art drum type copier, it has a few drawbacks. For example, the optical path includes a plurality of mirrors which reflect light emitting from the document glass onto the photosensitive belt. As the light rays are reflected from mirror to mirror, some of the light intensity is lost. Unless the light rays which strike the photosensitive belt are of a certain intensity, the belt is not properly discharged and the copy quality tends to be poor. The mirrors which are used to reflect the light rays often require optical alignment. Optical alignment is often difficult to achieve and expensive. A large number of the belt type copiers use toner for developing a latent image on the photosensitive belt. The toner tends to contaminate the mirror and adversely affects their light reflecting characteristics. Finally, it is often difficult to replace photosensitive belt in the above described type of copier. The difficulty stems from the fact that the mechanical biasing means which tension the belt has to be adjusted before the belt can be removed.

SUMMARY OF THE INVENTION

It is, therefore, the main objective of the present invention to disclose an improved electrophotographic copier having the best features of the belt type electrophotographic copier and the best features of the drum-type electrophotographic copier.

The improved electrophotographic copier includes a cylindrical drum journaled for rotation about a shaft mounted in a support frame. A document supporting platen is placed at the top of the support frame. A charging station, a developing/cleaning station and a transfer station are positioned around the periphery and in spaced alignment with the cylindrical drum. A vacuum chamber or column is positioned relative to the periphery of the cylindrical drum. The vacuum column is downstream from the charging station in the direction of drum rotation. A pair of spaced idler rollers are positioned next to the vacuum chamber. The periphery of the rollers are in a common plane with a platen located between the rollers. The rollers and the platen form an imaging station. The imaging station is below and in optical alignment with the document platen. An endless photosensitive belt is mounted on the cylindrical drum and the spaced idler rollers. When a vacuum is applied to the vacuum chamber, the belt is configured into a curved section and a flat section. Imaging of the photosensitive belt occurs at the flat section of the photoconductor belt.

In one feature of the invention, a flash illumination means is used to discharge the photosensitive belt.

The foregoing and other features and advantages of the invention will be apparent from the following more particular description of the preferred embodiment of the invention, as illustrated in the accompanying drawings.

DETAILED DESCRIPTION OF THE PREFERRED EMBODIMENT

Figure 1:
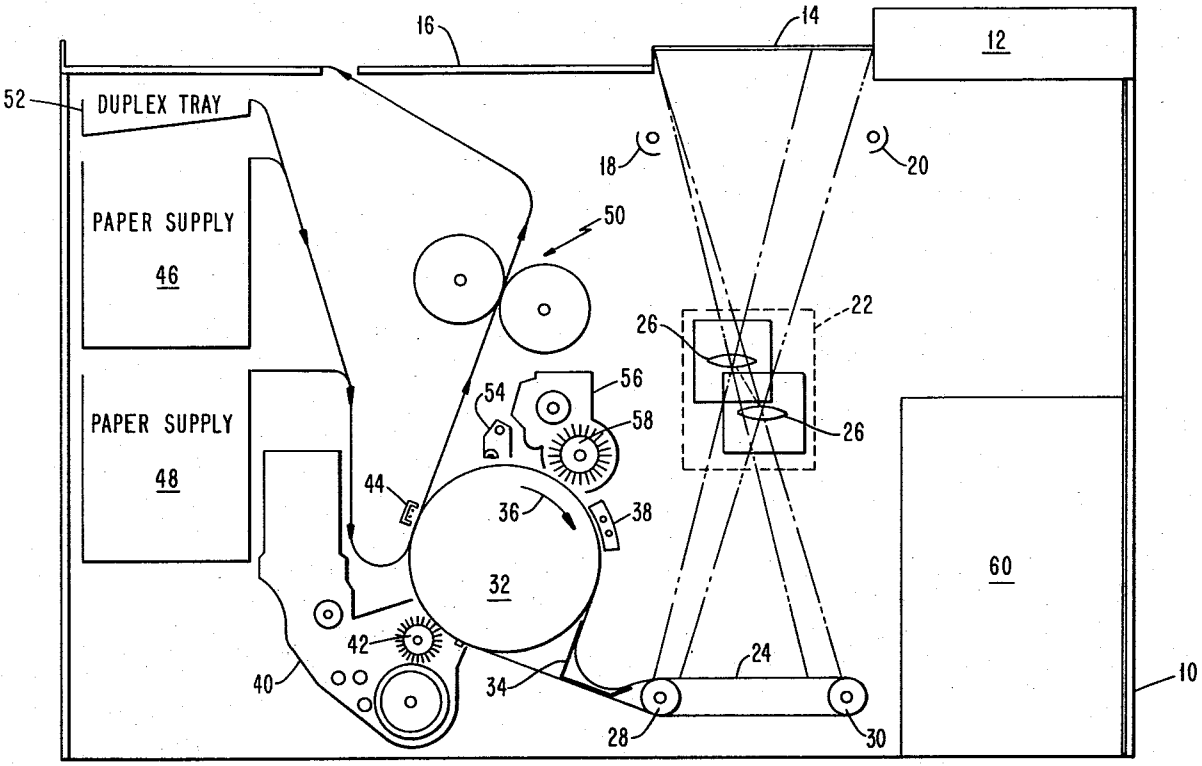
FIG. 1 shows a schematic view of an electrophotographic copier according to the teaching of the present invention.

FIG. 1 shows a schematic view of an electrophotographic copier. The schematic view embodies the teaching of the present invention. The electrophotographic copier includes a frame 10. The frame is the primary support for the components which coact to form the electrophotographic copier. A recirculating automatic document feed (RADF) 12 is positioned and affixed at the top right hand corner of the frame. The RADF is a conventional device. In operation, a plurality of original documents are placed in the RADF and the RADF feeds documents sequentially from a deposited stack onto the document glass 14. After the desired number of copies are made from an original document placed on the document glass, a feed mechanism (not shown) feeds the document from the document glass onto the original document tray 16. From the original document tray, the document is retrieved by an operator.

The document glass 14 is fabricated from a transparent material such as glass or clear plastic. Illumination means 18 and 20 are positioned below the document glass. When an original document is positioned on the glass and illumination means 18 and 20 are activated, the document glass and the documents thereon are illuminated. Although a plurality of illumination means may be used, in the preferred embodiment of the invention, the illumination means 18 and 20 are flash lamps having reflectors which focus or distribute the light at the document platen. A focusing assembly 22 is positioned directly below the document glass and in optical alignment thereto. As is used in this application, the term optical alignment means that light emanating from the document glass is focused directly through the focusing assembly 22 onto the photoconductor belt 24. Focusing assembly 22 includes focusing lens 26. In FIG. 1 the focusing lens is shown in two positions. In the topmost position, the electrophotographic machine is operating in the so-called nonreduction mode. In the nonreduction mode a copy is reproduced on a one to one basis. This means that the size of the copy is the same size as the original document. When the focusing lens 26 is positioned in the bottom or lower position, the machine is operating in the so-called reduction mode. In the reduction mode a copy is reproduced at a smaller size than the original document. In the preferred embodiment of the present invention a wide angle zoom lens with a constant total conjugate length is used as the focusing lens.

It is worthwhile noting that illumination lamps 18 and 20, together with focusing assembly 22, forms the imaging station for the electrophotographic copier. The function of the imaging station is to deposit a latent image of an original document, positioned on document glass 14, onto the photoconductor belt 24. The photoconductor belt 24 is configured into a curved run and a flat run, with imaging occurring at the flat run of the photoconductor belt. The flat run of the photoconductor is formed by idler rollers 28 and 30 respectively. The idler rollers are mounted, in spaced relationship, on frame 10 and as the photoconductor belt is transported passed the imaging station, the idler rollers are freely rotated therewith. The curved run of the belt is formed by a photoconductor drum 32. The drum is journaled for rotation onto the frame 10. The drum is mounted below the document glass but displaced laterally with respect to a perpendicular line drawn from the underside of the document glass towards the bottom of the electrophotographic copier. Likewise, the drum is displaced laterally and vertically from the flat run of the photoconductor belt. A vacuum chamber 34 forms a concave bend in the photoconductor. The concave bend allows a smooth transition between the curved run and the flat run of the photoconductor belt. Of greater importance is the fact that by using the vacuum column, instead of a mechanical member to bend the photoconductor belt, there is no physical contact between the bending means and the photoconductor belt. As will be explained subsequently, the vacuum chamber also operates as a means for tensioning the photoconductor belt and prevents the same from slipping as it is transported in its curvilinear and linear path.

Still referring to FIG. 1, the drum 32 is cylindrical in shape and is of sufficient diameter so that a plurality of processing stations can be positioned around the periphery. In the preferred embodiment of the present invention, the drum diameter is approximately eleven inches. The drum is rotated in a clockwise direction shown by arrow 36. The drum is driven by a drive mechanism including a motor (not shown). As the drum is rotated, it transports the photoconductor belt to pass within the vicinity of a plurality of processing stations. The first processing station which the photoconductor accesses is the charging station 38. At charging station 38, a conventional charge corona deposits a control charge on the surface of the photoconductor belt. The charged photoconductor belt is transported through the vacuum chamber 34 onto the flat area defined by idler rollers 28 and 30, respectively. The imaging station then deposits a latent image of a document positioned at the document glass 14 onto the photoconductor. The latent image is next transported to the developer station 40. The developer station 40 is positioned about the orbit of the photoconductor drum 32. The developer station is a conventional developer station and will not be described in detail. Suffice it to say at this point, that the developer station includes a fixing material such as toner which adheres to a multiplicity of carrier balls. A magnetic brush 42, having a predetermined electrical bias voltage thereon, allows for toner attaching to selective area of the latent image on the photoconductor belt. The carrier balls are deflected by the magnetic brush into the housing of the developer station. Positioned upstream from the developer station 40 and in the path of the photoconductor drum is the transfer station 44. The transfer station 44 includes a transfer corona. In order to transfer the toned image which now resides on the surface of the photoconductor, a sheet of paper is fed from the duplex tray 52 or paper supply trays 46 or 48, respectively. The sheet of paper moves along the paper path (shown by the arrows) between the transfer corona and the photoconductor drum 32. At this point the corona deposits a charge onto the paper. The charge on the paper is of opposite polarity to the toned image on the photoconductor. As a result of the electric field between the paper and the photoconductor surface, the toned image is transferred from the phtotconductor onto the transfer paper. The paper is then transported into fuser assembly 50. In the fuser assembly, the toner is fused preferably by some heating means, into the paper. The copy sheet is then transferred into an exit tray.

Positioned downstream from the transfer station 44 is a preclean lamp 54. After the image is transferred from the photoconductor surface, the preclean lamp illuminates the photoconductor. The illumination tends to neutralize the polarity of residual toner on the belt. The neutralized toner is then cleaned by the cleaning station 56 which is positioned downstream from the preclean lamp 54. The cleaning station 56 is fitted with brush 58. The brush scrubs the surface of the photoconductor and removes the residual toner. It should be noted that although the cleaning station and the developer station is shown as separate stations about the periphery of photoconductor drum 32, it is within the skill of the art to combine both stations without departing from the scope or spirit of the present invention. The electronics and power supplies which are necessary to operate the electrophotographic copier, are packaged and mounted in compartment 60. The compartment 60 is operably connected to frame 10 of the electrophotographic copier.

By configuring the photoconductor so that imaging occurs on a flat run of the photoconductor which is positioned straight down from the imaging station, the need for a plurality of mirrors which reflect light from the document platen is not needed as is the case in conventional belt copier. Also, the combination allows for a more compact overall electrophotographic copier.

Figure 2:
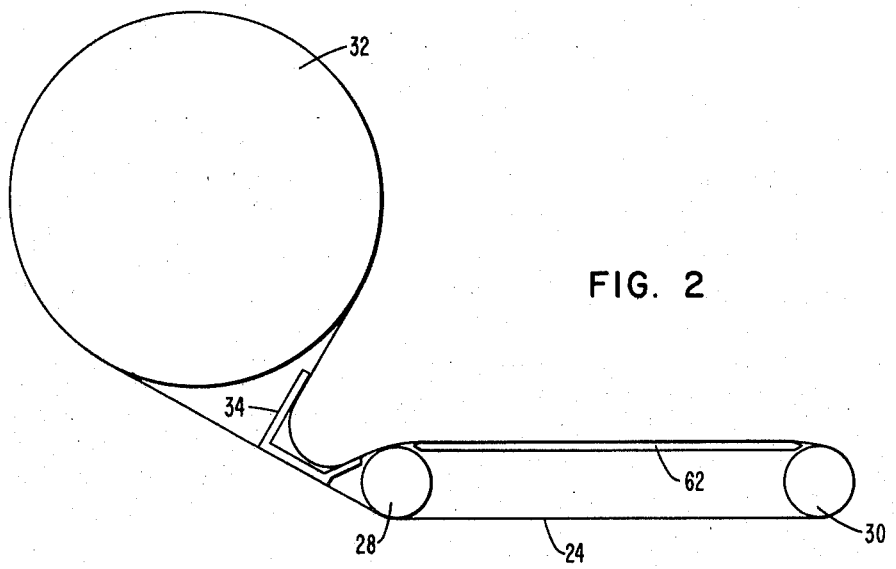
FIG. 2 is a schematic side view of the photoconductor path. The schematic is helpful in understanding the configuration of the electrophotographic copier.
Figure 3:
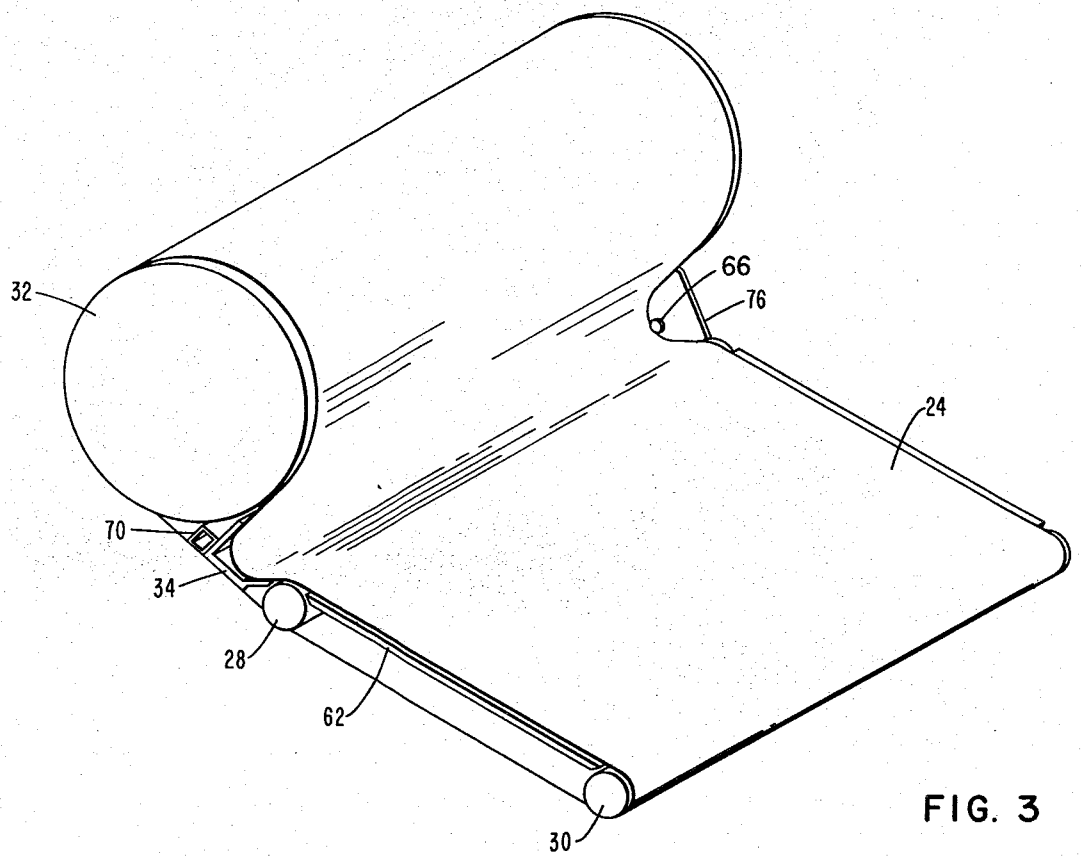
FIG. 3 is a pictorial or plane view of the photoconductor path of FIG. 2.

Referring now to FIGS. 2 and 3, a side and pictorial view of the photoconductor path is shown. Elements in FIGS. 2 and 3 which are common to FIG. 1 will be identified with the same numeral. The curved section of the photoconductor path is defined by drum 32. The drum has a cylindrical shape with the length of the major axis substantially equivalent to the width of the photoconductor 24. As was stated earlier, a plurality of conventional electrophotographic processing stations are positioned about the periphery of the drum. The stations have already been identified and will not be repeated at this point. A vacuum chamber 34 is positioned relative to the drum. The relationship is such that the inner surface of one of the sides of the vacuum chamber is in tangential alignment to the surface of the drum. As such, as the photoconductor exits the periphery of the drum, it enters the vacuum chamber. When negative pressure is applied to the vacuum chamber, the photoconductor is held firmly against the surface of the cylindrical drum and the surface of platen 62. Idler roller 28 is positioned between the exit side of the vacuum chamber and guides the photoconductor onto the platen. In the preferred configuration, the inner walls of another side of the vacuum chamber is in tangential alignment to the curved surface of roll 28. Similarly, idler roller 30 guides the photoconductor belt as it exits from the platen. A pair of knobs, only one of which is shown and is identified as numeral 66, is mounted, one on each of the inside surfaces of the end walls of the vacuum column. The knobs protrude slightly into the vacuum column. The knobs prevent the photoconductor belt from escaping out of the vacuum column particularly when the pressure to said vacuum column is turned off.

Figure 4:
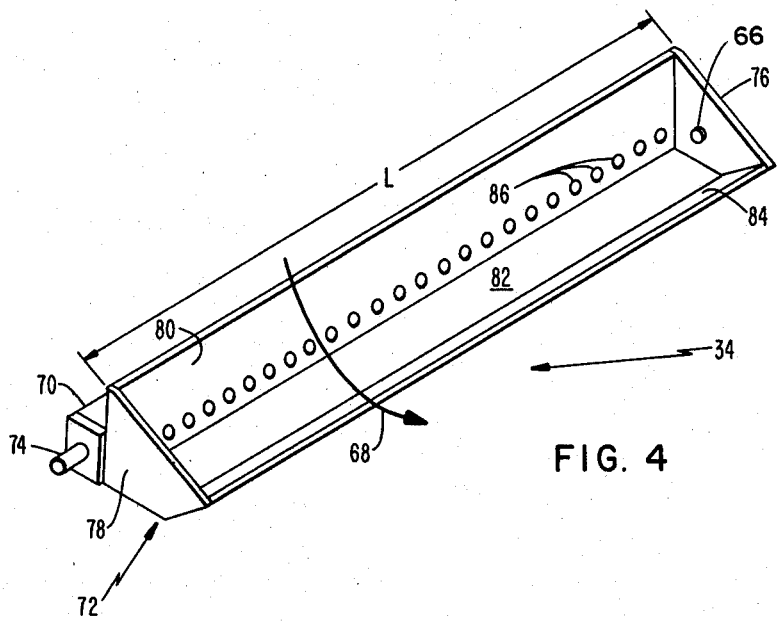
FIG. 4 shows a pictorial view of the vacuum chamber.
Figure 5:
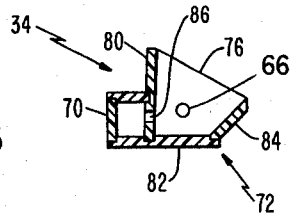
FIG. 5 shows a cross-section of the vacuum chamber.

FIGS. 4 and 5 show a pictorial view and a cross-sectional view, respectively, of the vacuum chamber 34. The vacuum chamber is an elongated chamber with a length, L, which is substantially equivalent to the width of the photoconductor. In the electrophotographic copier configuration of FIG. 1, the vacuum chamber is positioned so that its length is running traversely to the direction of motion of the photoconductor. By way of example, in FIG. 4 the photoconductor would be moving in a direction shown by arrow 68. The vacuum chamber includes an air plenum 70 with a photoconductor support trough or chamber 72 attached thereto. A conduit hose 74 is attached to a vacuum supply source (not shown) and supplies a vacuum in the air plenum. The photoconductor trough or chamber includes end members 76 and 78 respectively. Elongated side members 80, 82 and 84 are arranged at an angle with respect to each other. The side members and the end members are then assembled and fastened to form the photoconductor trough shown in FIG. 4. In addition to giving structural support or rigidity to the photoconductor trough, the end members are the means for guiding the photoconductor laterally. As the photoconductor belt exits the cylindrical surface of photoconductor drum 32 (FIG. 1) and is transported through the vacuum chamber onto the imaging platen, the photoconductor belt tends to move in a direction traverse to the direction of normal belt motion. The presence of end members 76 and 78, respectively, guide the edges of the photoconductor to eliminate the traverse motion. Of course it is within the skill of the art to design other types of containers without departing from the scope and spirit of the present invention. In order to interconnect the photoconductor trough with the vacuum air plenum, a plurality of holes 86 are fabricated on side member 80. Whenever a source of negative vacuum is connected to air plenum 70 via conduit 74 and the photoconductor is positioned so that its width is running parallel to the length (L) of the vacuum chamber, a bight of the photoconductor belt is pulled into the trough and, as a result, creates the reverse band which allows the smooth transition from the curved run to a flat run and also tensions the photoconductor about the drum and the platen and idler rollers. In order to remove the photoconductor belt, the negative pressure is dropped and the belt is then free to be removed.

Although the preferred embodiment of the apparatus is shown and described above, it is within the skill of the art to make various changes and modifications to the apparatus, all of which are intended to be within the scope and spirit of the invention as defined by the following claims.

What is claimed is:

1. An improved electrophotographic copier comprising in combination:

a support frame;

a flat document platen mounted on the support frame;

full-frame illumination means for simultaneously illuminating all portions of a document positioned on said document platen;

a cylindrical drum rotatably mounted to the frame; said drum rotating about an axis which is parallel to the plane of the document platen; said drum being positioned below the document platen and laterally disposed from the document platen;

a flat image platen parallel to said document platen, disposed below and in optical alignment with the document platen; said image platen being fixed in position and displaced horizontally from the cylindrical drum and below the drum's axis;

an endless photoconductor belt mounted to the image platen and the cylindrical drum; and bending means positioned below the drum's axis and horizontally from the image platen; said bending means being operable to create a concave bend in the photoconductor belt so that said photoconductor belt is configured into a flat run about the image platen whereat full-frame imaging occurs, and into a cylindrical run about the cylindrical drum, said cylindrical run accommodating a charging station, a development station, a transfer station and a cleaning station.

2. The electrophotographic copier of claim 1 further including lens means having an optical axis which is perpendicular to the document platen and the image platen, said lens means being positioned directly below the document platen and being operable to intercept light rays emanating from the document platen and focusing the same onto the flat run of the photoconductor.

3. The electrophotographic copier of claim 1 further including fuser means operably positioned for fusing copies exiting from the transfer station.

4. The electrophotographic copier of claim 1 wherein the bending means is a vacuum chamber;

said vacuum chamber having one inner surface in tangential alignment to the surface of said drum.

5. The electrophotographic copier of claim 4 wherein the image platen includes:

a pair of spaced rollers mounted to have parallel axes which are parallel to the axis of said drum, one of said rollers being positioned closer to the drum than is the other roller;

said vacuum chamber having a further inner surface in tangential alignment to the curved surface of that roller which is positioned closest to said drum; and a flat support member positioned between said rollers to define said flat photoconductor run.

6. The electrophotographic copier of claim 5 wherein the vacuum chamber pulls on the back side of the photoconductor.

7. An improved electrophotographic copier comprising:

a support frame;

a flat document glass positioned at the top of said frame;

a flat image projection platen, parallel to said document glass, and fixed in position directly below the document glass and in optical alignment therewith;

a cylindrical drum rotatably mounted to the frame; said drum being vertically and laterally displaced from the image platen; said drum rotating about an axis which is parallel to both the document glass and the image platen;

an endless photoconductor belt operably mounted to the drum and platen; and a vacuum means positioned relative to the drum and the image platen, and operable for configuring and tensioning said photoconductor belt so that the photoconductor belt forms a flat run at the image platen and forms a wrap greater than 270° about the cylindrical drum;

said vacuum means being of a general V-shape in the direction of belt movement, and having a first wall whose extension is tangent to said drum at the drum surface whereat the belt leaves the drum, and having a second wall whose extension is tangent to said image platen at the surface where the belt first engages the image platen.

8. The electrophotographic copier of claim 7 further including drive means operable to drive the drum and thereby transport the photoconductor belt.

9. Means for supporting a photoconductor belt in an electrophotographic device comprising:

a support frame;

a rotatable cylindrical drum mounted to said frame;

an elongated, V-shaped container having a first and a second wall and operable to contain a bight of the photoconductor belt; said container being mounted downstream of said drum in the direction of belt movement, and being mounted so that its elongated axis runs parallel to the axis of said cylindrical drum;

a flat support platen mounted downstream from said elongated container;

means for supplying vacuum to the elongated container;

said first wall of said container receiving said belt tangent to the portion of the drum whereat said belt leaves the drum, and said second wall of said container thereafter discharging the belt in a plane which is tangent to the belt's line of initial contact to said support platen; and means for producing a latent image on said belt as the belt traverses said support platen.

* * * * *